US005105797A

United States Patent [19]

Gulutzen et al.

[11] Patent Number: 5,105,797

[45] Date of Patent: Apr. 21, 1992

[54] SOLID FUEL BURNING STOVE

[76] Inventors: Alexander M. Gulutzen; W. Stanley Gulutzen, both of R.R. #3, Blyth, Ontario, Canada, N0M 1H0

[21] Appl. No.: 735,641

[22] Filed: Jul. 25, 1991

[51] Int. Cl.[5] ..... F24C 1/14

[52] U.S. Cl. ..... 126/61; 126/99 A; 126/72; 126/146

[58] Field of Search ..... 126/99 A, 110 R, 109, 126/61, 66, 72, 146; 110/110, 102, 300

[56] References Cited

U.S. PATENT DOCUMENTS

| | | | |
|---|---|---|---|
| 585,027 | 6/1897 | Gurney . | |
| 864,864 | 9/1907 | Sanders . | |
| 1,648,976 | 11/1927 | Wagner . | |
| 1,707,096 | 3/1929 | Rich . | |
| 4,127,100 | 11/1978 | Baker | 126/66 |
| 4,173,966 | 11/1979 | Scharen . | |
| 4,184,473 | 1/1980 | McIntire et al. | 126/66 |
| 4,267,817 | 5/1981 | Hicks et al. . | |
| 4,290,410 | 9/1981 | Trainer | 126/146 |
| 4,404,954 | 9/1983 | Steel . | |
| 4,548,194 | 10/1985 | Schafer et al. | 126/110 R |
| 4,738,241 | 4/1988 | Bernelov et al. . | |
| 4,803,973 | 2/1989 | Harman . | |

*Primary Examiner*—Carroll B. Dority
*Attorney, Agent, or Firm*—Roper & Quigg

[57] ABSTRACT

A solid fuel burning stove is provided and includes a housing within which a combustion chamber is located. The combustion chamber receives combustion air via an adjustable inlet formed through a channel member running along the base of the housing. The channel member defines a combustion air duct which communicates with a combustion air intake in the rear wall of the housing. Combustion air is drawn into the stove via the air intake and is forced through the combustion air duct by a fan. The combustion air passes through the adjustable inlet into the combustion chamber. A fire box is located within the combustion chamber above the adjustable inlet and holds the solid fuel to be combusted. Hot flue gases heat air flowing through a plurality of heat exchange tubes passing through the combustion chamber. The heated air flowing through the heat exchange tubes is directed into the room in which the stove is located via a plurality of vents in the front wall of the housing. The hot flue gases are then discharged from the stove via an exhaust in the rear of the stove. A hopper is also located within the housing and provides solid fuel to a delivery system which automatically replenishes the solid fuel in the fire box.

28 Claims, 4 Drawing Sheets

SOLID FUEL BURNING STOVE

FIELD OF THE INVENTION

The present invention relates to heating elements and in particular to solid fuel burning stoves. More specifically, the present invention relates to solid fuel burning stoves which burn fuel in the form of pellets such as, for example, kernels of corn, wheat, rye and beans.

BACKGROUND OF THE INVENTION

Many types of stoves have been considered for burning different solid fuels. Typically these types of stoves have been designed to burn wood, although stoves for burning other solid fuel in the form of pellets, such as kernels of corn, have been considered. When designing solid fuel burning stoves regardless of the type of solid fuel being used, it is desired to increase the efficiency of the stove so that the amount of heat radiated by the stove is relatively high. It is also desired to ensure that the stove burns the fuel cleanly and substantially completely so that cleaning of the stove is kept at a minimum.

An example of a solid fuel burning stove is illustrated in U.S. Pat. No. 4,127,100 to Baker. This patent discloses a wood burning stove including a fan to force air through a plurality of heat exchange tubes extending through the combustion chamber in the stove. The heat exchange tubes include vertical sections which run along one wall of the combustion chamber and horizontal sections which run along the top of the combustion chamber. An adjustable air inlet is provided in the door of the stove to allow the flow of air into the combustion chamber to be controlled. Hot flue gases pass over the horizontal sections of the heat exchange tubes and are then directed downwardly on the other side of the one wall by a baffle before being expelled from the stove via the flue. Since the hot flue gases pass over the horizontal sections of the heat exchange tubes and run along the one wall supporting the vertical sections of the heat exchange tubes, the temperature of the air passing through the heat exchange tubes and directed to the room in which the stove is located is increased.

Other designs for solid fuel burning stoves can be seen in U.S. Pat. No. 4,738,241 to Bernelov, U.S. Pat. No. 4,267,817 to Hicks et al, U.S. Pat. No. 4,173,966 to Scharen, and U.S. Pat. No. 1,707,096 to Rich.

Although many designs for solid fuel burning stoves have been considered, improved designs for such stoves are continually being sought.

It is, therefore, an object of the present invention to provide a novel solid fuel burning stove.

SUMMARY OF THE INVENTION

According to one aspect of the present invention there is provided a solid fuel burning stove comprising:

a housing having combustion air inlet means, combustion air outlet means, ambient air inlet means and heated air outlet means;

a combustion chamber within said housing communicating with said combustion air inlet means via adjustable valved inlet means to permit the rate of combustion air flow into said combustion chamber to be varied, said combustion chamber communicating with said combustion air outlet means to permit combustion gasses to exit said housing;

a fuel receptacle for holding solid fuel within said combustion chamber and overlying said valved inlet means; and a plurality of heat exchange tubes passing through the combustion chamber, said tubes receiving air to be heated via said ambient air inlet means and discharging heated air to said heated air outlet means.

Preferably, the combustion air inlet is constituted by a combustion air duct communicating with an inlet in a wall of said housing and the valved inlet means includes an annulus surrounding a passage in the combustion air duct, the annulus removably receiving washers having different central diameters thereby to permit the flow of air to be varied. It is also preferred that air forcing means in the form of an electrically operated fan draws air into the stove housing via the inlet in communication with the combustion air duct with the combustion air duct directing the combustion air through the valved inlet into the combustion chamber.

Preferably, the stove includes secondary heat exchange means in the form of a secondary passage for air to be heated with the passage extending along at least one side of the combustion chamber and above the top thereof, the housing having a second outlet communicating with the secondary passage allowing for the discharge of heated air.

It is also preferred that the stove include a fuel bin and delivering means for delivering fuel automatically to the fuel receptacle within the combustion chamber. Preferably, the delivering means is in the form of a motor driven auger.

According to another aspect of the present invention there is provided a solid fuel burning stove comprising:

a housing having combustion air inlet means, combustion air outlet means, ambient air inlet means and heated air outlet means;

a combustion chamber within said housing communicating with said combustion air inlet means to permit combustion air flow into said combustion chamber, said combustion chamber communicating with said combustion air outlet means to permit combustion gasses to exit said housing;

a fuel receptacle for holding solid fuel within said combustion chamber;

heat exchange means in the form of a plurality of heat exchange tubes passing through the combustion chamber, said tubes receiving air to be heated via said ambient air inlet means and discharging heated air to said heated air outlet means; and blowing means in said combustion chamber and discharging forced air therethrough towards said combustion air outlet means to inhibit accumulation of particulate material in said combustion chamber.

Preferably, the combustion chamber further includes a baffle dividing the combustion chamber into a combustion zone and an exhaust zone, with the baffle directing hot combustion gasses in the combustion zone through the exhaust zone to the combustion air outlet means.

It is also preferred that the blowing means includes a first blower adjacent the baffle, the first blower discharging forced air over the baffle towards the exhaust zone. Preferably, the blowing means also includes a second blower adjacent the combustion outlet means, the second blower discharging forced air out of the stove via the combustion air outlet means. It is also preferred that the first and second blowers means are in the form of pipes extending from the combustion air inlet means.

According to yet another aspect of the present invention there is provided a solid fuel burning stove comprising:

a housing having combustion air inlet means, combustion air outlet means, ambient air inlet means and heated air outlet means;

a combustion chamber within said housing communicating with said combustion air inlet means to permit combustion air flow into said combustion chamber, said combustion chamber communicating with said combustion air outlet means to permit combustion gasses to exit said housing;

a fuel receptacle for holding solid fuel within said combustion chamber;

first heat exchange means in the form of a plurality of heat exchange tubes passing through the combustion chamber, said tubes receiving air to be heated via said ambient air inlet means and discharging heated air to said heated air outlet means; and secondary heat exchange means in the form of a secondary passage in communication with said ambient air inlet means, said passage extending along at least one upright wall of said combustion chamber and above the top thereof, said housing having second heated air outlet means communicating with said secondary passage to allow heated air in said passage to exit said housing.

In still yet another aspect of the present invention there is provided a solid fuel receptacle for use in a solid fuel burning stove comprising:

a base;

side walls extending upwardly from the edges of said base;

a top spaced from said base and spanning said sidewalls, said top being curved downwardly towards said base to define a dish for holding fuel, at least a portion of said top being perforated; and a combustion air inlet provided through one of said base and side walls.

Preferably, the inlet is centrally located in the base and the curved top is semi-cylindrical.

The present stove provides advantages in that, due to the provision of the multiple heat exchange tubes passing through the combustion chamber and the secondary heat exchange means in the form of the passage surrounding a wall and the top of the combustion chamber, the temperature of heat radiated by the present stove is substantially increased as compared with prior art designs. Furthermore, the provision of the adjustable inlet means which permits the rate of air flow into the combustion chamber to be controlled, allows the present stove to burn efficiently various types of solid fuels. Moreover, the provision of the forced air into the combustion chamber and the fuel bin inhibit the accumulation of ash within the stove thereby reducing cleaning requirements.

BRIEF DESCRIPTION OF THE DRAWINGS

An embodiment of the present invention will now be described by way of example only with reference to the accompanying drawings in which.

DESCRIPTION OF THE PREFERRED EMBODIMENT

Figure 1:
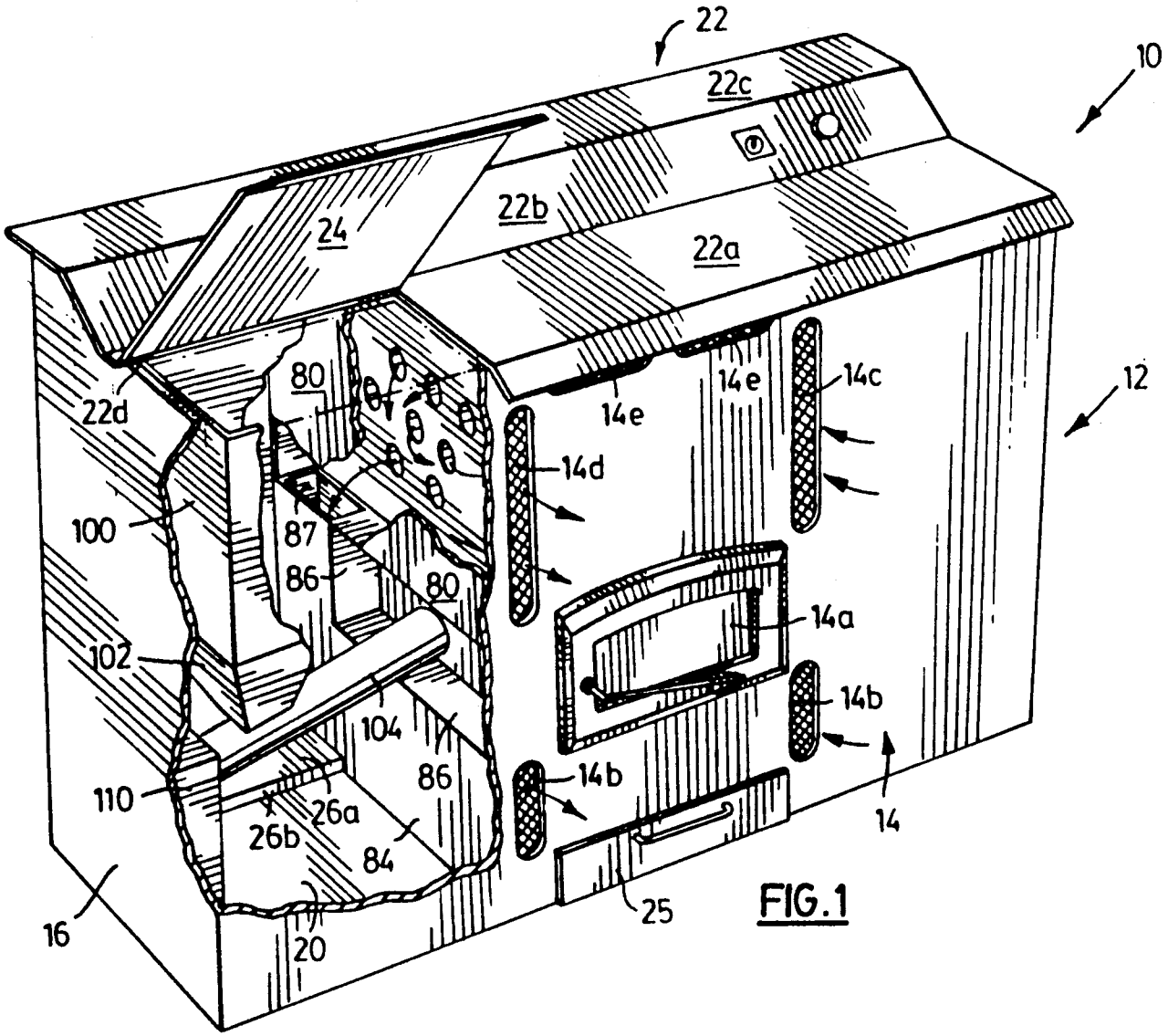
FIG. 1 is an oblique view of a solid fuel burning stove taken from the front.
Figure 2:
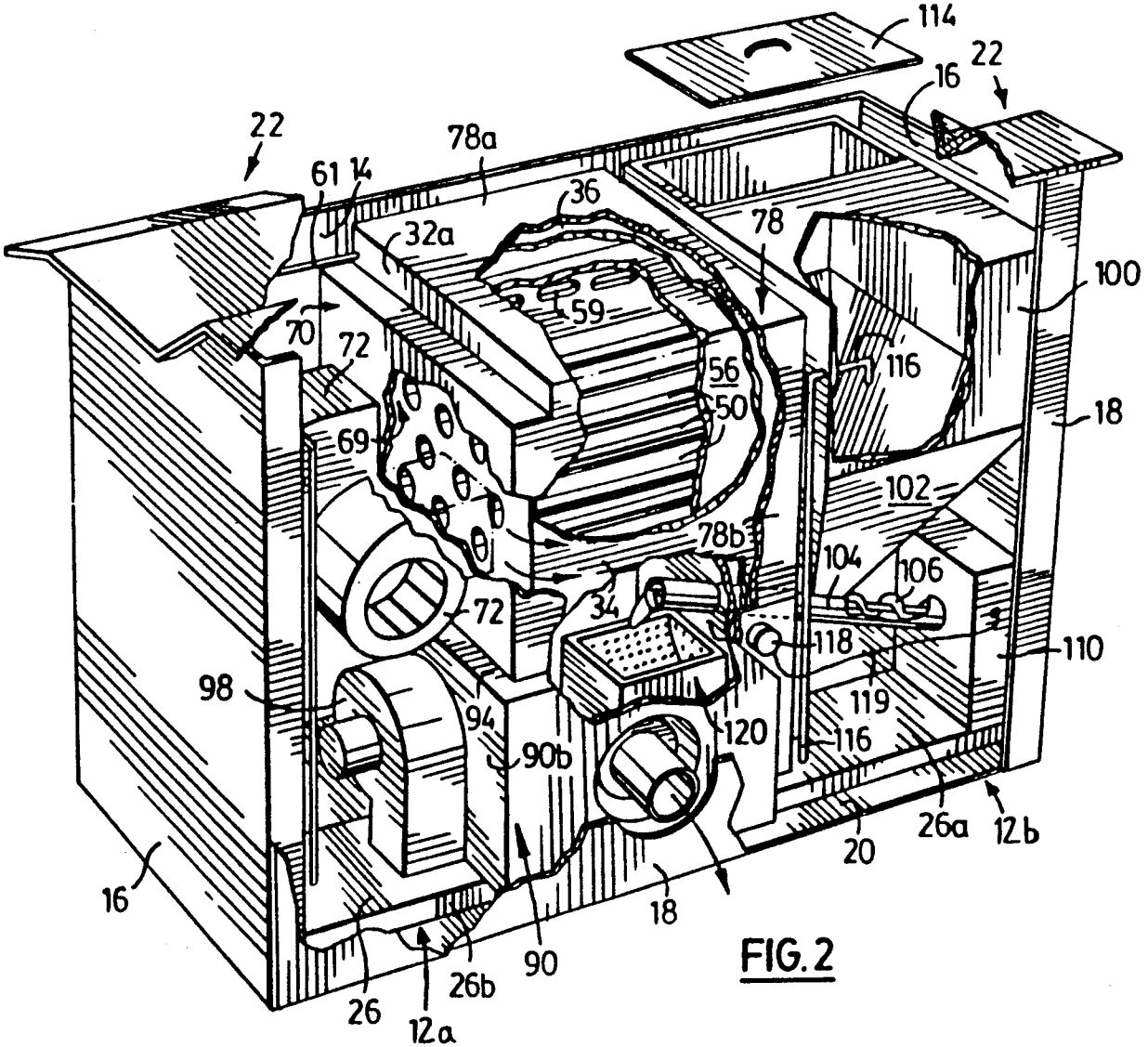
FIG. 2 is an oblique view of the stove illustrated in FIG. 1 partially in section taken from the rear.
Figure 4:
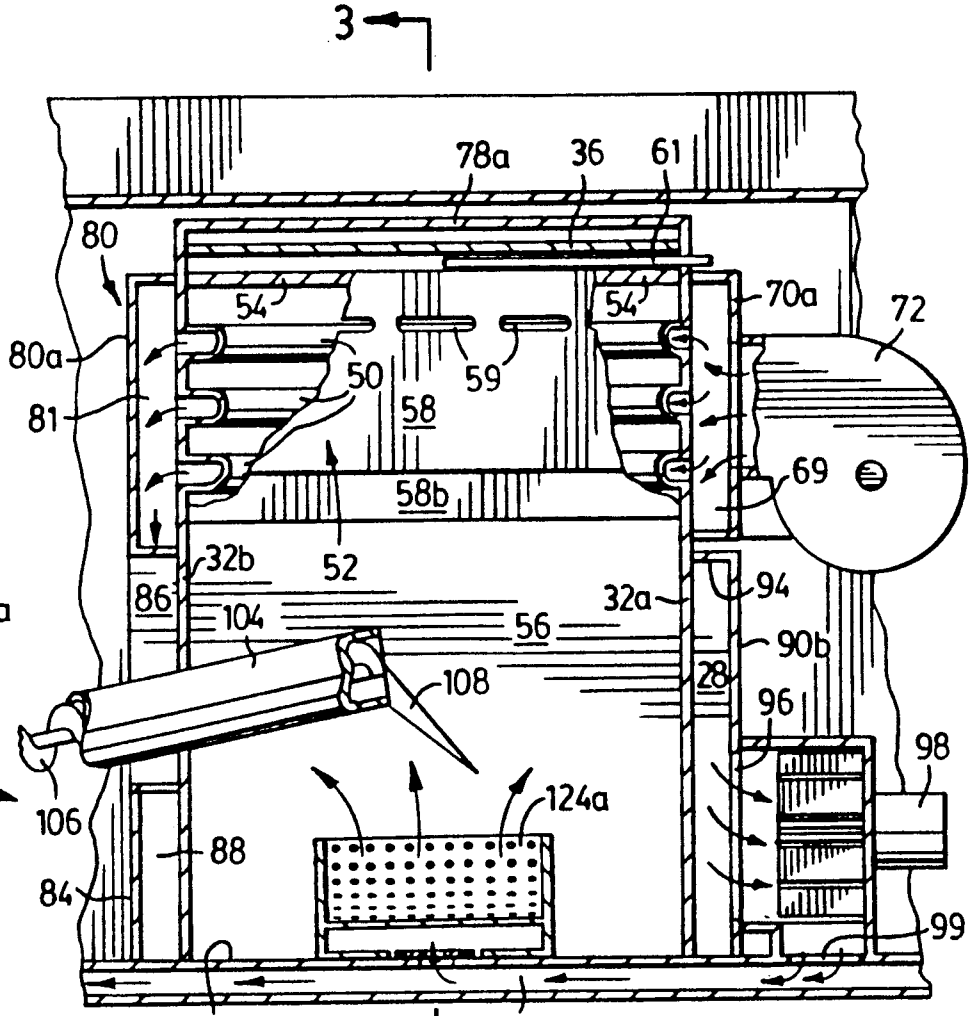
FIG. 4 is a sectional view of the stove illustrated in FIG. 3 taken along line 4—4.
Figure 3:
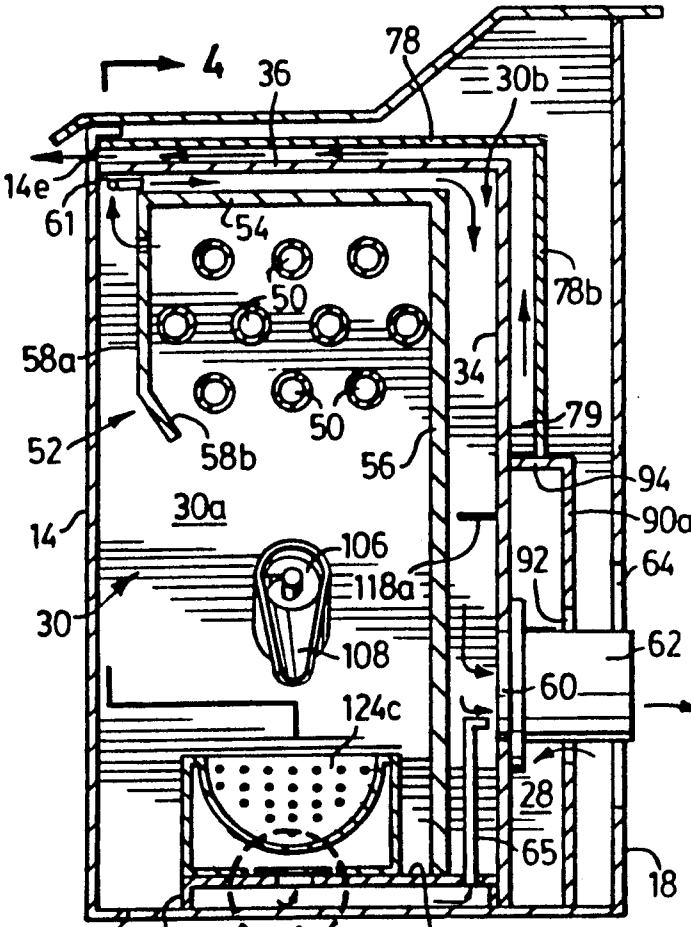
FIG. 3 is a sectional view of the stove illustrated in FIG. 4 taken along line 3—3.

Referring to FIGS. 1 and 2, a solid fuel burning stove is shown and is generally indicated by reference numeral 10. The stove 10 is formed from welded plate-steel. All components in the stove 10 to be described are fastened to one another by air tight welds unless stated otherwise. The stove 10 includes a generally rectangular, box-shaped housing 12 having a front wall 14, a pair of end walls 16 and a rear wall 18. The front, rear and side walls extend upwardly from the edges of a base 20. A top 22 is welded to the upper edges of the front, rear and side walls respectively. The top 22 includes a front horizontal portion 22*a* having a forwardly depending lip, a rearwardly and upwardly inclined portion 22*b* defining an instrument panel and a rear horizontal portion 22*c*. A section of the front portion 22*a* is pivotable about a hinge 22*d* to define a lid 24.

A door 14*a* is provided on the front wall to permit access to a portion of the housing 12 interior. A pair of laterally spaced, generally ovate vents 14*b* are provided in the front wall on opposite sides of and slightly below the door 14*a*. Larger passages 14*c* and 14*d* are also provided through the front wall on opposite sides of and slightly above the door 14*a*. Two additional vents 14*e* are provided through the front wall just below the upper peripheral edge of the front wall. The vents 14*e* are positioned above the passages 14*c* and 14*d* and directly over the door 14*a* and are arranged so that their major axis is horizontal, normal to that of the other vents and passages. Steel mesh overlies the interior surface of the front wall to cover the vents and passages to inhibit entry of objects into the interior of the housing 12 while still allowing air to flow into and out of the stove 10 as will be described. A tray 25 for collecting ash is provided below the door 14*a* and can be pulled out of the housing via a handle.

With reference now to all of the Figures, the interior of the housing 12 is better illustrated and will now be described. As can be seen, an inverted U-shaped member 26 having a top 26*a* and a pair of side walls 26*b* extends the entire length of the base 20 with the space between the base 20 and the top 26*a* of the member 26 constituting a combustion air duct 28. A combustion chamber 30 is centrally located within the housing 12 and rests on the base 20 to define separated sections 12*a* and 12*b* on either side of the combustion chamber.

The combustion chamber 30 includes a pair of side walls 32*a*, 32*b* having recesses formed adjacent their lower edges to accommodate the member 26. A rear wall 34 extends between the side walls 32 while a top 36 overlies the upper edges of the side and rear walls 32, 34 respectively. The front wall of the combustion chamber 30 is constituted by the interior surface of a portion of the front wall 14 adjacent the door 14*a* so that opening of the door exposes the interior of the combustion chamber 30.

Figure 5:
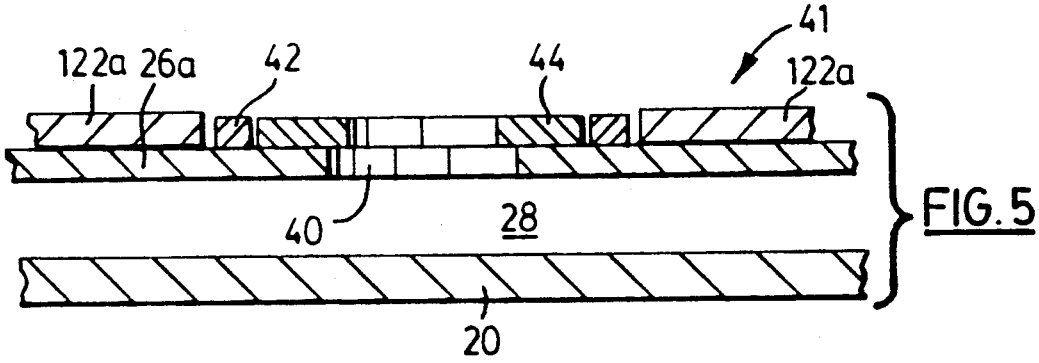
FIG. 5 is a sectional view of a portion of the stove illustrated in FIG. 4.
Figure 6:
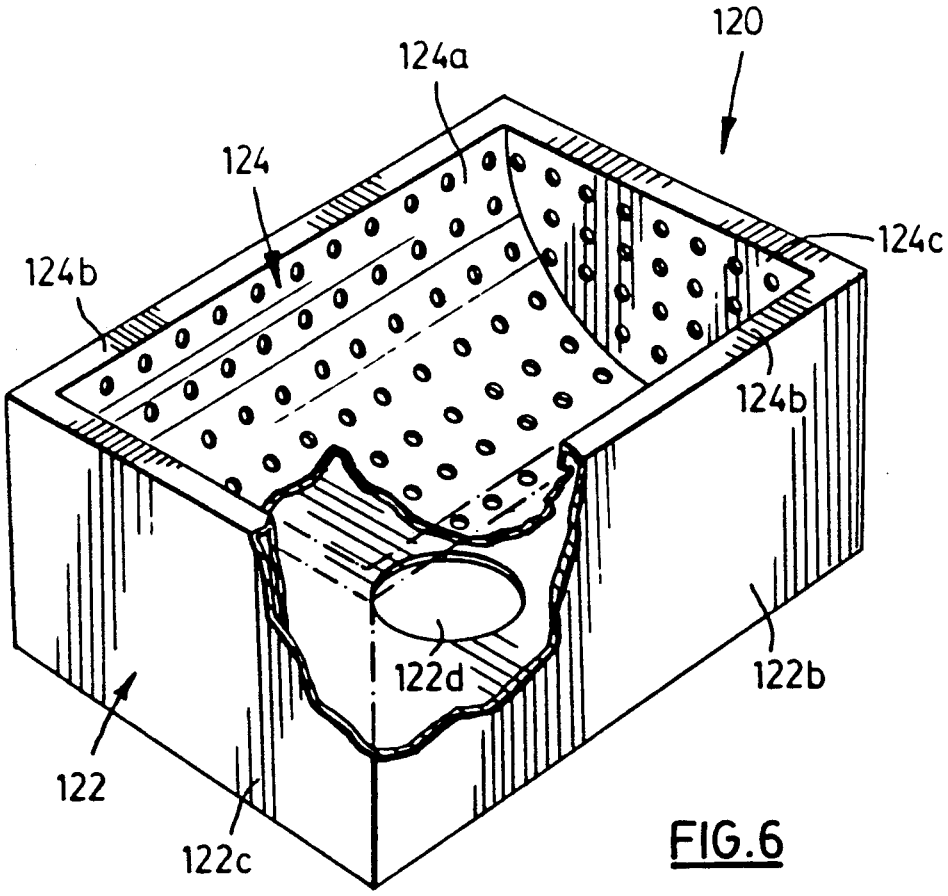
FIG. 6 is a perspective view of a portion of the stove illustrated in FIG. 2.

A circular aperture 40 is formed in the top 26*a* of the member 26 at the centre of the combustion chamber 30 to define a combustion chamber air inlet 41 (best shown in FIG. 5). An annular ring 42 having an interior opening of larger diameter than the aperture 40 is welded to the top of the member 26 so that its opening surrounds the aperture. Removable washers 44 with different interior diameters are removably received in the opening of the annular ring 42 to permit the diameter of the combustion chamber air inlet 40 to be varied. This allows the air flow rate into the combustion chamber 30 to be controlled which is particularly beneficial when different types of solid fuel are used in the stove 10.

A plurality of parallel heat exchange tubes 50 arranged in vertically spaced rows extend between the side walls 32 of the combustion chamber 30 near the top thereof and constitute the primary heat exchanger of the stove. A baffle 52 is located within the combustion chamber 30 above the heat exchange tubes 50 and extends between the side walls 32 to divide the combustion chamber into two zones, namely a combustion zone **30*a* and an exhaust zone 30*b*. The baffle 52 includes an upper plate 54 parallel to but spaced from the top 36 of the combustion chamber 30. The front and rear edges of the upper plate 54 are spaced from the front and rear walls of the combustion chamber respectively. A back plate 56 depends from the rear edge of the upper plate 54 and has its lower edge welded to the top of the member 26. A front plate 58 having a vertical section 58*a* and a rearwardly depending lip 58*b* depends from the front edge of the upper plate 54. The front plate 58 terminates slightly below the lowermost heat exchange tubes 50. Spaced slots 59 are provided through the vertical section 58*a* near the upper plate 54. A blower 61 in the form of a steel pipe 61 extends from the member 26 and passes through the side wall 32*a* of the combustion chamber 30 near its top 36. The blower 61 terminates within the chamber 30 between the top 36 and the upper plate 54 and provides air flow over the plate 54 towards the rear wall 34 of the combustion chamber 30 to assist air flow through the exhaust zone 30*b* and to inhibit ash from collecting on the upper plate 54**.

A cylindrical outlet pipe 62 surrounds an aperture 60 formed in the rear wall of the combustion chamber 30 and extends through a passage 64 formed in the rear wall 18 of the housing 12 to permit combustion air, hot flue gasses and ash to be exhausted from the stove 10. To assist air flow out of the pipe 62 and to inhibit the accumulation of ash in the pipe 62, another blower 65 in the form of a steel pipe is provided. Blower 65 extends from the member 26, between the rear plate 56 of the baffle 52 and the combustion chamber rear wall 34 and forces air into the pipe 62.

A pan-shaped member 70 has its four end walls secured to the outer surface of the combustion chamber wall **32*a* so that they surround the openings to the heat exchange tubes 50. The space 69 between the outer wall 70*a* of the member 70 and the chamber wall 32*a* defines an ambient air intake. Electrically operated fans 72 are secured to the outer wall 70*a* of the member 70. The exhausts of the fans 72 are in communication with the space 69 via apertures provided through the wall 70*a*. The intakes of the fans 72 draw air from within the housing 12 which enters the housing via one of the vents 14*b* and the passage 14*c* formed in the front wall 14. The fans 72 in turn force the air into the space and through the heat exchange tubes 50. The fans 72 are controlled by a timer (not shown) which can be operated via a dial on the instrument panel 22*b***.

An angle 78 having an upper plate **78*a* and a back plate 78*b* is positioned so that the upper plate 78*a* sits above the top 36 of the combustion chamber 30 and so that the back plate 78*b* is spaced from the rear wall 34 of the combustion chamber 30. The upper plate 78*a* is welded to the front wall 14 of the housing 12 above the vents 14*e*. One end wall of the pan-shaped member 70 is welded along one edge of the back plate 78*b* of the angle 78 so that the space 69 also communicates with the space 79 between the back plate 78*b* and the rear wall 34. Flanges extend from the other edges of the top and back plates 78*a* and 78*b* respectively and are welded to the outer walls of the combustion chamber 30 so that air entering into the space 79 between the back plate 78*b* and rear wall 34 is directed above the top of the combustion chamber before exiting the stove 10 via the vents 14*e***.

A member 80 has its three end walls secured to the side wall **32*b* of the combustion chamber 30 so that they surround the other openings to the heat exchange tubes 50. The space 81 between the outer wall 80*a* of the member and the combustion chamber side wall 32*b* defines a portion of a heated air exhaust. The edge of wall 80*a* and the end walls adjacent the front wall 14 are welded to the front wall so that the space 81 communicates with the passage 14*d* to allow heated air leaving the heat exchange tubes 50 and entering the space 81 to exit the stove 10** and heat the room in which the stove is located.

An L-shaped member 84 sits below the member 80 and is spaced from the side wall **32*b* of the combustion chamber. Flanges 86 extend from the edges of the member 84 and are welded to the side wall 32*b* to define the remainder of the heated air exhaust. The flange extending from the upper edge of the vertical arm of the member 84 has an aperture 87 formed through it which communicates with the space 81 via an aperture in the lower end wall of the member 80. Heated air entering the space 88 between the member 84 and the side wall 32*b* is directed to the vent 14*b* wherein the heated air is discharged from the stove 10**.

A corner 90 constituted by a rear wall **90*a* and a side wall 90*b* sits below the angle 78 and is spaced from the side wall 32*a* and rear wall 34 of the combustion chamber 30. An aperture 92 in the rear wall 90*a* allows the cylindrical pipe 62 to pass. Flanges 94 extend from the edges of the corner 90 and are welded to the combustion chamber 34 with the space defined between the walls of the combustion chamber and corner respectively defining a portion of the combustion air duct 28. An aperture 96 is formed in the side wall 90*b* and communicates with the air intake of a fan 98. The exhaust of the fan 98 overlies an aperture 99 in the channel member 26 so that air drawn into the stove 10 via the aperture 92 surrounding the pipe 62 is directed through the adjustable inlet 41 into the combustion chamber via combustion air duct 28. The fan 98 is also controlled by the timer controlling fans 72**.

A hopper 100 sits in the second section **12*b* of the housing 12 below the lid 24. The hopper 100 holds solid fuel (in this example, corn kernels) to be combusted and angles inwardly at its bottom to define a funnel 102. The funnel 102 feeds an angled cylindrical pipe 104 which houses an auger 106. One end of the pipe 104 extends between member 80 and member 84 and passes through an opening in the side wall 32*b* of the combustion chamber 30. The pipe 104 terminates within the combustion chamber and has an angled flap 108 extending downwardly from its end. A motor 110 is located adjacent the inner surface of the side wall 16 and is operable to rotate the auger 106. When the auger is rotated within the pipe 104, pellets of solid fuel are conveyed along the pipe and discharged into the combustion chamber 30. The top of the hopper 100 has a removable lid 114 positioned below the lid 24 so that the hopper can be filled with fuel. The lid 114 forms a sealed fit with the hopper 110 to prevent air flow through the lid. A blower 116 in the form of a steel pipe extends from the member 26 and passes through a wall in the hopper 100. The blower 116 terminates in a downwardly extending section and provides air flow downwardly through the hopper 100 into the pipe 104. This inhibits combustion air from passing through the pipe 104 and entering the hopper 100. A thermostat 118 is mounted on the rear wall 34 of the combustion chamber and has a probe 118***a* which passes into the exhaust zone 30*b* of the combustion chamber 30. The output of the thermostat 118 is applied to the motor 110 via a conductor 119.

A removable fire box 120 is located within the combustion chamber 30 and rests on the member 26 above the adjustable air inlet 41, below the flap 108. The fire box 120 includes a pan 122 having a base 122*a*, a pair of side walls 122*b* and a pair of end walls 122*c*. A circular aperture 122*d* is formed through the center of the base 122*a* and is sized to receive the annular ring 42. A dish 124 is in the pan 122 and has a semi-cylindrical portion 124*a* with horizontal flanges 124*b* at two of its edges. The horizontal flanges 124*b* overlie the top edges of the pan side walls so that the semi-cylindrical portion sits above the base 122*a*. A pair of semi-circular side walls 124*c* complete the dish 124 and are secured to the pan end walls as well as to the curved edges of the semi-cylindrical portion 124*a*. The walls 124*a* and 124*c* of the dish are perforated to permit air flow therethrough.

The operation of the present stove will now be described with reference to the Figures. Before operating the stove, it is desired to fill the hopper 100 with the kernels of corn to be used as fuel and this is achieved by opening the lids 24 and 114 to expose the interior of the hopper. With fuel in the hopper, the fuel is conveyed to the cylindrical pipe 104 via the funnel 102. Thus, when the motor 110 is actuated to rotate the auger 106, the auger 106 moves the corn kernels along the pipe 104 and discharges the kernels of corn into the dish 122 of the fire box 120.

Before this is done however, when using corn as a solid fuel, it is necessary to start a fire in the combustion chamber 30 using fuel which burns at a lower temperature than corn kernels. It has been found that small wood pellets achieve this result satisfactorily. In addition, it is necessary to place a washer 44 having the proper internal diameter in the opening of the annular 42 to ensure that the combustion air flow into the chamber 30 is sufficient for the type of solid fuel stored in the hopper 100. Once the proper washer 44 has been selected, the fire box 120 is placed over the inlet 41 and the wood pellets are placed in the dish 124. The wood pellets are then ignited using suitable starting material. Access to the interior of the combustion chamber 30 to perform to the above is achieved via the door 14*a*.

To facilitate combustion of the fuel within the chamber 30, the timer is operated via the dial so that the fan 98 draws air into the combustion air duct 28 via the apertures in the rear wall of the housing 12 and in the back wall 90*a* of the corner 90. The air is forced by the fan 98 along the duct 28 and into the combustion chamber 30 via the adjustable inlet 40.

The thermostat 118 measures the temperature in the combustion chamber 30 and when the temperature reaches a temperature of approximately 100° C., another timer (not shown) is operated. The timer in turn connects the motor 110 to a power supply for a predetermined amount of time. The time is selected so that the auger 106 is rotated for a duration sufficient to allow only enough corn kernels to be deposited into the dish 124 to fill the fire box 120. With the corn kernels deposited on an existing fire burning at a temperature sufficient to ignite the corn kernels, combustion of the corn kernels within the stove 10 occurs.

As the fuel burns, hot flue gasses rise within the combustion chamber 30 and heat the heat exchange tubes 50. The hot flue gasses then pass around the opening to the exhaust section 30*b* of the combustion chamber 30 due to the baffle 52. The slits 59 in the baffle 52 reduce turbulence in the flow of the flue gasses. The flue gasses are then directed between the back wall 34 of the combustion chamber 30 and the rear plate 56 of the baffle 52 to the cylindrical pipe 62. The flue gasses are assisted by the flow of air from the blower 61 towards the rear wall 34 of the combustion chamber. The pipe 62 directs the flue gasses through the rear wall 18 of the housing so that the gasses are expelled from the stove. The flow of flue gasses through the pipe 62 is also assisted by the flow of air from the blower 65.

As this occurs, the fans 72 which operate when fan 98 is operated, draw air from within section 12*a* of the housing and force the air into the space 69. Some of the air is forced through the heat exchange tubes 50 and heated. The heated air in turn leaves the heat exchange tubes 50 and is directed to the space 81. Most of the heated air exits the stove via the passage 14*d*. The balance of the heated air from the tubes is directed to the space 88 and leaves the stove via the vent 14*b*. The reminder of the air entering the space 69 that does not enter the tubes 50 enters the space 79 between angle 78 and the combustion chamber 30. While fuel is being combusted, the blower 116 forces air downwardly towards the funnel to prevent combustion gasses from flowing into the hopper 110 via the pipe 104. The heated air within the space 79 is directed into the room via the vents 14*e* in the front wall 14.

During the combustion of corn, a by-product of the combustion called "klinker" results. As the klinker builds up over prolonged combustion it will at some time extinguish the fire and thus, it is necessary to clean the fire box 120 to remove the klinker accumulated in the dish. The curved wall 124*a* of the dish 124 and the perforations facilitate the removal of the klinker and also increase the amount of corn which can be combusted before the klinker accumulates to a point sufficient to extinguish the fire. Once the klinker is removed, the hot coals are replaced back on the dish 124 to ensure that the corn kernels ignite when the auger 106 is actuated.

Since it is necessary to access the combustion chamber to clean the fire box 120 to remove klinker when burning corn, it is desirable that the stove burn the fuel cleanly. This is achieved by providing the valved inlet 41 which limits combustion air flow into the chamber 30 to a rate sufficient to maintain a high temperature within the chamber. In addition, the provision of the slits 59 in the baffle 52 which reduce turbulent flow, help to reduce the amount of soot and other particulate by-products resulting from the fire accumulated in the combustion chamber 30. This is further enhanced by the blower 61 which forces air over the top plate 54 of the baffle 52 toward the rear wall 34 of the combustion chamber and the blower 65 which forces air into the cylindrical pipe 62.

The present invention provides advantages in that fuel burned in the stove is done so, cleanly thereby reducing the accumulation of soot in the stove 10. Also, the provision of multiple heat exchange paths for air to be heated allows the present stove to radiate heat at higher temperatures than conventional solid fuel burning stoves.

We claim:

1. A solid fuel burning stove comprising:

a housing having combustion air inlet means, combustion air outlet means, ambient air inlet means and heated air outlet means;

a combustion chamber within said housing communicating with said combustion air inlet means via controllable inlet means to permit the rate of combustion air flow into said combustion chamber to be varied, said combustion chamber communicating with said combustion air outlet means to permit combustion gasses to exit said housing;

a fuel perforated receptacle for holding solid fuel within said combustion chamber and overlying said controllable inlet means, means forming an enclosure between said fuel receptacle and said controllable inlet means whereby the supply of air through said perforated receptacle can be controlled; and a plurality of heat exchange tubes passing through the combustion chamber, said tubes receiving air to be heated via said ambient air inlet means and discharging heated air to said heated air outlet means.

2. A stove as defined in claim 1 further wherein said combustion air inlet means includes a combustion air duct communicating with an inlet in a wall of said housing and extending into said combustion chamber, said combustion air duct having a passage formed therethrough below said fuel receptacle, said controllable inlet means including an annulus surrounding the passage, said annulus removably receiving washers having different central diameters thereby to permit said flow of combustion air through said passage into said combustion chamber to be varied.

3. A stove as defined in claim 2 further including air forcing means for drawing combustion air into said combustion air duct via said inlet, said combustion air duct directing the combustion air through said passage and washer and into said combustion chamber.

4. A stove as defined in claim 3 wherein said air forcing means is in the form of an electrically operated fan.

5. A stove as defined in claim 1 further including secondary heat exchange means in the form of a secondary passage in communication with said ambient air inlet means, said passage extending along at least one upright wall of said combustion chamber and above the top thereof, said housing having second heated air outlet means communicating with said secondary passage to allow heated air to be discharged from said housing.

6. A stove as defined in claim 5 wherein said secondary passage runs along the rear and top walls of said combustion chamber, said second heated outlet means communicating directly with said secondary passage above said top wall.

7. A stove as defined in claim 1 wherein said combustion chamber further includes a baffle dividing said combustion chamber into a combustion zone and an exhaust zone, said baffle directing hot combustion gasses in said combustion zone through said exhaust zone to said combustion air outlet means.

8. A stove as defined in claim 7 wherein slits are formed in said baffle adjacent one edge thereof, said slits reducing the occurrence of turbulence in said combustion gasses entering said exhaust zone.

9. A stove as defined in claim 1 further including a fuel bin and delivering means for delivering fuel automatically to said fuel receptacle within the combustion chamber within said housing.

10. A stove as defined in claim 9 wherein said delivering means is in the form of a motor driven auger.

11. A stove as defined in claim 1 further including air forcing means drawing ambient air into said stove via said ambient air inlet means and forcing said ambient air through said heat exchange tubes.

12. A stove as defined in claim 11 wherein said air forcing means is in the form of at least one electrically operated fan.

13. A stove as defined in claim 7 further comprising blowing means located in said combustion chamber adjacent said baffle, said blowing means discharging forced air over said baffle towards said exhaust zone.

14. A stove as defined in claim 13 further including second blowing means adjacent said combustion air outlet means, said second blowing means discharging forced air out of said housing via said combustion air outlet means.

15. A stove as defined in claim 14 wherein said first and second blowing means are in the form of pipes extending from said combustion air duct.

16. A stove as defined in claim 9 wherein further including blowing means in said fuel bin, said blowing means discharging forced air towards said delivering means.

17. A stove as defined in claim 16 wherein said blowing means is in the form of a pipe extending from said combustion air duct.

18. A solid fuel burning stove comprising:

a housing having combustion air inlet means, combustion air outlet means, ambient air inlet means and heated air outlet means;

a combustion chamber within said housing communicating with said combustion air inlet means to permit combustion air flow into said combustion chamber, said combustion chamber communicating with said combustion air outlet means to permit combustion gasses to exit said housing;

a perforated means forming a controllable combustion air inlet means below said perforated fuel receptacle; means forming an enclosure between said perforated fuel receptacle and said combustion air inlet means whereby the supply of air through said perforated fuel receptacle can be controlled; fuel receptacle for holding solid fuel within said combustion chamber;

first heat exchange means in the form of a plurality of heat exchange tubes passing through the combustion chamber, said tubes receiving air to be heated via said ambient air inlet means and discharging heated air to said heated air outlet means; and secondary heat exchange means in the form of a secondary passage in communication with said ambient air inlet means, said passage extending along at least one upright wall of said combustion chamber and above the top thereof, said housing having second heated air outlet means communicating with said secondary passage to allow heated air in said passage to exit said housing.

19. A stove as defined in claim 18 wherein said secondary passage runs along the rear and top walls of said combustion chamber, said second outlet means communicating directly with said secondary passage above said top wall.

20. A stove as defined in claim 19 wherein said first heated air outlet means includes duct means providing a pair of paths for heated air exiting said tubes along the side of said combustion chamber and a pair of spaced outlets in the front wall of said housing, each of said outlets communicating with a different one of said paths.

21. A solid fuel burning stove comprising:

a housing having combustion air inlet means, combustion air outlet means, ambient air inlet means and heated air outlet means;

a combustion chamber within said housing communicating with said combustion air inlet means to permit combustion air flow into said combustion chamber, said combustion chamber communicating with said combustion air outlet means to permit combustion gasses to exit said housing;

a fuel receptacle for holding solid fuel within said combustion chamber;

heat exchange means in the form of a plurality of heat exchange tubes passing through the combustion chamber, said tubes receiving air to be heated via said ambient air inlet means and discharging heated air to said heated air outlet means; and blowing means in said combustion chamber and discharging forced air therethrough towards said combustion air outlet means to inhibit accumulation of particulate material in said combustion chamber.

22. A stove as defined in claim 21 wherein said combustion chamber further includes a baffle dividing said combustion chamber into a combustion zone and an exhaust zone, said baffle directing hot combustion gasses in said combustion zone through said exhaust zone to said combustion air outlet means.

23. A stove as defined in claim 22 wherein said blowing means includes a first blower adjacent said baffle, said first blower discharging forced air over said baffle towards said exhaust zone.

24. A stove as defined in claim 23 wherein said blowing means includes a second blower adjacent said combustion air outlet means, said second blower discharging forced air out of said housing via said combustion air outlet means.

25. A stove as defined in claim 24 wherein said first and second blowers means are in the form of pipes extending from said combustion air inlet means.

26. A solid fuel receptacle for use in a solid fuel burning stove comprising:

a base;

side walls extending upwardly from the edges of said base;

a top spaced from said base and spanning said sidewalls, said top being curved downwardly towards said base to define a dish for holding fuel, at least a portion of said top being perforated; and a combustion air inlet provided through one of said base and side walls.

27. A receptacle as defined in claim 26 wherein said inlet is centrally located in said base.

28. A receptacle as defined in claim 27 wherein said curved top is semi-cylindrical.

* * * * *

UNITED STATES PATENT AND TRADEMARK OFFICE

CERTIFICATE OF CORRECTION

PATENT NO. : 5,105,797

DATED : April 21, 1992

INVENTOR(S) : Alexander M. Gulutzen

It is certified that error appears in the above-indentified patent and that said Letters Patent is hereby corrected as shown below:

Column 9, line 22, delete "fuel perforated" and insert therefor -- perforated fuel --.

Column 9, line 24, delete "means, means" and insert therefor -- means --.

Column 10, lines 48-55, delete the entire sub-paragraph and insert therefor -- a perforated fuel receptacle for holding solid fuel within said combustion chamber; means forming a controllable combustion ait inlet means below said perforated fuel receptacle; means forming an enclosure between said perforated fuel receptacle and said combustion air inlet means wherby the supply of air through said perforated fuel receptacle can be controlled; --

Signed and Sealed this

Sixth Day of July, 1993

*Attest:*

Michael K. Kirk

MICHAEL K. KIRK

*Attesting Officer*

*Acting Commissioner of Patents and Trademarks*